United States Patent [19]

Ivey

[11] Patent Number: 4,751,373

[45] Date of Patent: Jun. 14, 1988

[54] TIME PERIOD CALCULATOR

[76] Inventor: Robert L. Ivey, 14844 Sunset Blvd., Pacific Palisades, Calif. 90272

[21] Appl. No.: 900,762

[22] Filed: Aug. 27, 1986

[51] Int. Cl.[4] ..... G06C 3/00

[52] U.S. Cl. ..... 235/84; 235/78 R; 235/88 R

[58] Field of Search ..... 235/70 B, 78 R, 78 M, 235/78 N, 83, 84, 85 R, 88 R, 88 M, 88 N; 40/113, 115; 283/2, 3

[56] References Cited

U.S. PATENT DOCUMENTS 1,435,512 11/1922 Boggio ..... 235/84

3,253,780 5/1966 Stewart et al. ..... 235/83 X

*Primary Examiner*—Benjamin R. Fuller

*Attorney, Agent, or Firm*—Lyon & Lyon

[57] ABSTRACT

A time period calculator employing a base, a calendar disc, a calculation disc and a cursor. The calendar disc includes divisions identified by months and days of the year about a common axis. The calculation disc is divided into increments of time in days, weeks and months from zero consecutively in both clockwise and counterclockwise directions for measuring time periods prospectively and retrospectively, respectively. The base may include divisions divided into 1/365th segments with day of the week indications thereon. The cursor includes line segments offset over the calendar disc divisions by one day so as to accommodate leap year calculations.

5 Claims, 1 Drawing Sheet

FIG. 1.
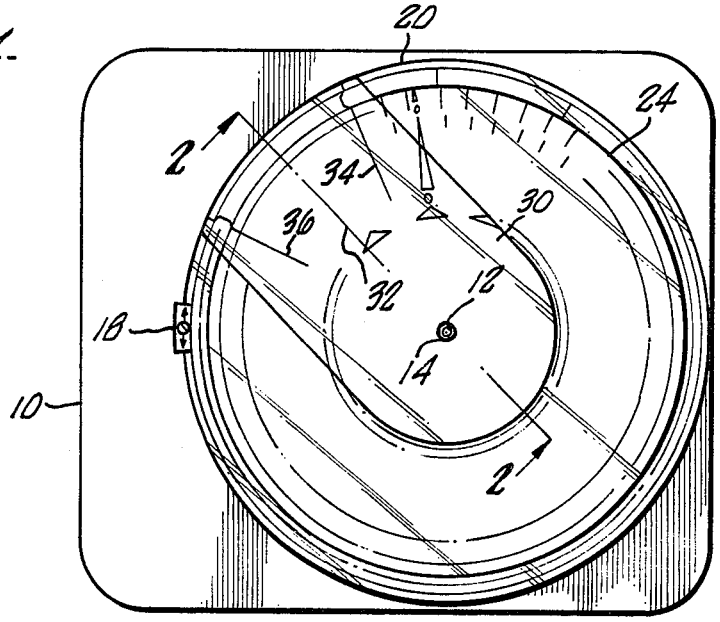
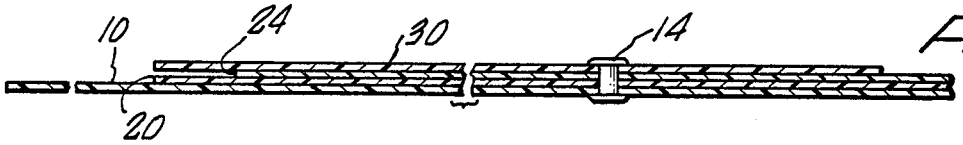
FIG. 2.
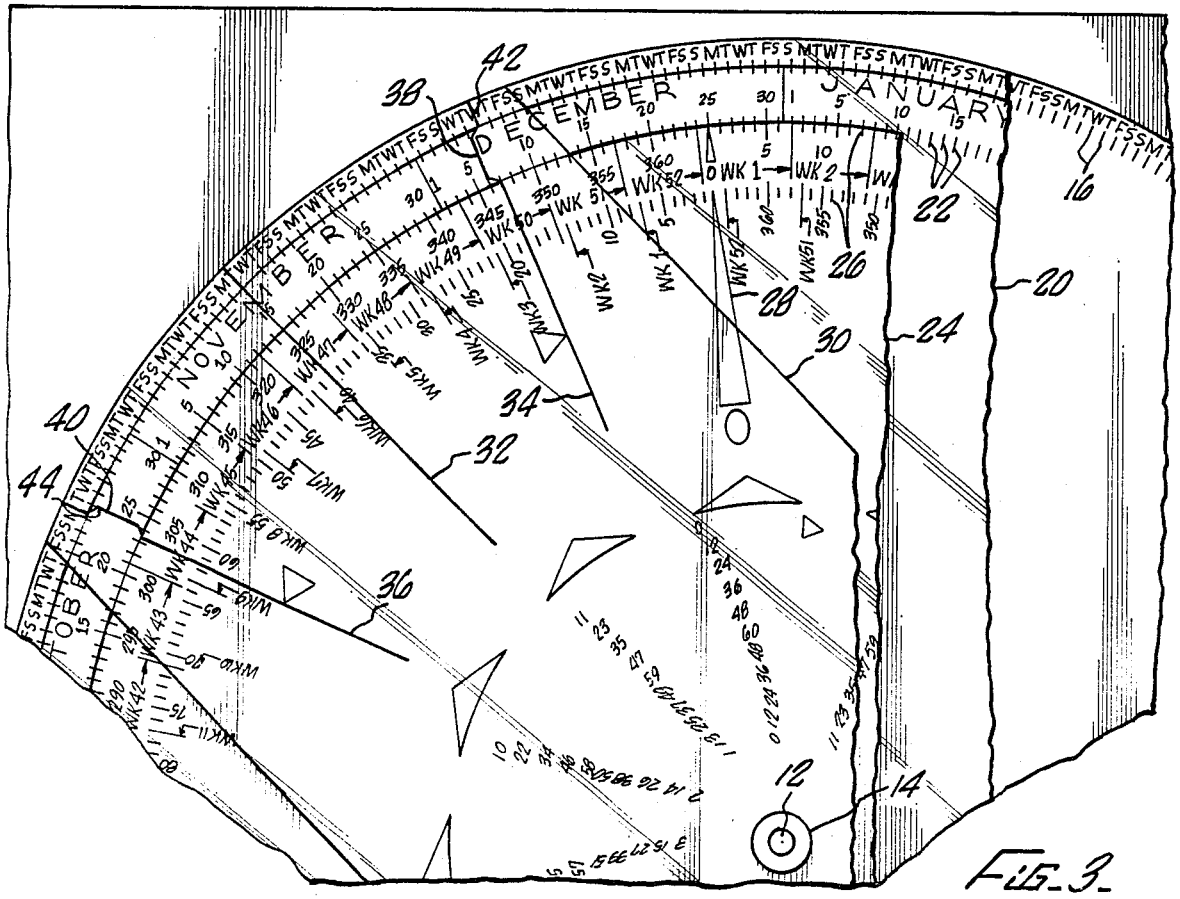
FIG. 3.

TIME PERIOD CALCULATOR

BACKGROUND OF THE INVENTION

The field of the present invention is calendars and calculation of time periods.

Attorneys, construction and production supervisors and managers, and other professions find themselves repeatedly calculating periods of time in days, weeks and months either forwardly or backwardly for purposes of establishing a date at some increment of time from a given starting date, or of counting days or weeks between dates, and needing to know the day of the week of the found date. These calculations can be critical in terms of deadlines, imposed under rules, contractual obligations and the like. Difficulties in such calculations result from unequal months, the lack of an even division of weeks during leap year.

Calendars provide an inconvenient method for such calculation, particularly for longer periods of time. Electronic means may be employed using electronically stored data, but such a system is unnecessarily complicated, is likely to be expensive and is naturally subject to failure.

SUMMARY OF THE INVENTION

The present invention is directed to a time period calculator which may be easily employed to calculate dates set off from some known date by a period of days, weeks and years to measure intervals between dates, and to find the day of the week for any date. Accommodation for leap year is specifically provided for measuring either forwardly or backwardly across February 29.

In accomplishing the foregoing, a base may be employed to which discs are pivoted about a common axis. A calendar disc may provide increments of a year about its circumference. These increments would typically include months and days thereof. A calculation disc may be employed which presents increments of time in days, weeks and months, cumulatively numbered from zero in each direction. Finally, a cursor may be employed which includes markings for correlating increments of the various elements. In addition, lines are provided which are offset at the calendar disc by one day such that calculations across February 29 can be accurately undertaken.

Accordingly, it is an object of the present invention to provide a time period calculator in a calculator wheel format which is capable of calculating periods of time even across February 29. Other and further objects and advantages will appear hereinafter.

BRIEF DESCRIPTION OF THE DRAWINGS

FIG. 1 is a plan view of a time period calculator of the present invention.

FIG. 2 is a cross-sectional side view taken along line II—II of FIG. 1.

FIG. 3 is a detailed plan view of a portion of the time period calculator of FIG. 1.

DETAILED DESCRIPTION OF THE PREFERRED EMBODIMENT

Turning in detail to the drawings, FIG. 1 illustrates a time period calculator employing a base 10 which is shown to be conveniently larger than the discs. Printed indicia may be included on the base 10 for purposes of aiding in the time period calculations. For example, a table is contemplated by the preferred embodiment which would correlate the days of the week to each January 1st for a useful period of years surrounding the year of manufacture of the device. Such a table might appear as follows:

| | | Weekday of January 1: | | | | |
|---|---|---|---|---|---|---|
| MON | TUES | WED | THUR | FRI | SAT | SUN |
| 1900 | 1901 | 1902 | 1903 | 1904* | | 1905 |
| 1906 | 1907 | 1908* | | 1909 | 1910 | 1911 |
| 1912* | | 1913 | 1914 | 1915 | 1916* | |
| 1917 | 1918 | 1919 | 1920* | | 1921 | 1922 |
| 1923 | 1924* | | 1925 | 1926 | 1927 | 1928* |
| | 1929 | 1930 | 1931 | 1932* | | 1933 |
| 1934 | 1935 | 1936* | | 1937 | 1938 | 1939 |
| 1940* | | 1941 | 1942 | 1943 | 1944* | |
| 1945 | 1946 | 1947 | 1948* | | 1949 | 1950 |
| 1951 | 1952* | | 1953 | 1954 | 1955 | 1956* |
| | 1957 | 1958 | 1959 | 1960* | | 1961 |
| 1962 | 1963 | 1964* | | 1965 | 1966 | 1967 |
| 1968* | | 1969 | 1970 | 1971 | 1972* | |
| 1973 | 1974 | 1975 | 1976* | | 1977 | 1978 |
| 1979 | 1980* | | 1981 | 1982 | 1983 | 1984* |
| | 1985 | 1986 | 1987 | 1988* | | 1989 |
| 1990 | 1991 | 1992* | | 1993 | 1994 | 1995 |
| 1996* | | 1997 | 1998 | 1999 | 2000* | |

*Indicates Leap Year

The base 10 defines an axis 12 located somewhat centrally in the base 10. The axis is defined centrally in a rivet 14 as can best be seen in FIG. 2. Postioned equiangularly about the axis 12 are divisions 16. These divisions are 1/365th of a full circle. One portion of the circle defined by these divisions includes an arc 18 without such divisions. Associated with the divisions 16 are representations of the days of the week. Because of the area available for printing, the preferred embodiment employs the periodic representations "S M T W T F S", generally recognized by all English speaking people as the first letters of the names of the days of the week.

Positioned on the base 10 and fixed to rotate about the axis 12 by means of the rivet 14 is a calendar disc 20. The calendar disc 20 may be of clear plastic such that it may extend over and protect the divisions 16 on the base 10. The calendar disc 20 is divided into 365 equiangular divisions 22 which extend completely around the outer portion of the disc 20. These divisions are grouped into months and days of the month with January, for example, having 31 days, February having 28 and April having 30. It has been selected, principally in accordance with Western convention, to arrange the days and months in sequence in a clockwise direction. The days of the week indications at the divisions 16 on the base 10 are also so arranged. Through reference to the foregoing chart, January 1 of the year in question may be aligned with one of the indications of the days of the week on the base 10 to then provide an identification of the day of the week for any date within 357 days in either direction from January 1.

Also pivotally affixed to the base 10 is a calculation disc 24. The calculation disc 24 is able to rotate relative to the calendar disc 20 and the base 10. The calculation disc 24 has divisions 26 equiangularly placed about the outer portion of the disc 24. The calculation disc 24 has a 0 point 28 from which the divisions are consecutively numbered from 0 in each direction. Numbers are found in increments of 5 for space reasons with one set going clockwise and one set going counterclockwise to represent up to 365 day increments. Other increments may be selected. Weeks are also indicated in both directions with week 52 falling one day short of a full year in each direction. The consecutive numbering of months may also be employed, even in excess of one-year periods.

A cursor 30 is also pinned about the center axis 12 by the rivet 14. The cursor 30 includes a first radial line 32 extending radially outwardly relative to the axis 12 to cross the divisions 16, 22 and 26. This line 32 is straight. Another radial line 34 also extends outwardly in a similar manner as does a third radial line 36. The radial lines 34 and 36 are intended to accommodate for periods of time extending over February 29 in a leap year. The line 34 is employed for calculating time periods prospectively and the line 36 is employed for calculating time periods retrospectively across February 29. Hence, each of lines 34 and 36 have a first segment which extends across the divisions 26. A one-day shift is accommodated by a leap year segment 38 and 40 on lines 34 and 36, respectively. These leap year segments are displaced angularly from the main segments of lines 34 and 36 by one day with segment 38 being displaced counter-clockwise and segment 40 being displaced clockwise. A third segment 42 and 44 extends outwardly from each of the segments 38 and 40, respectively. These segments 42 and 44 are aligned with the radial lines 34 and 36, respectively, to indicate the day of the week found in leap year calculations. As an alternative, the cursor lines 32, 34 and 36 may be drawn together. Such an arrangement only requires the operator to be more careful in selection of line segments to employ.

To employ the device in a period of time not extending over a February 29 in leap year, the zero 28 is set on the known date from which a time period is to be calculated. In FIG. 3, this known date is shown to be December 25. If a prospective time period is contemplated, one looks to the clockwise direction. With the location of the cursor centerline 32 located at 325 days as measured by divisions 26, that period of 325 days after December 25 is shown to fall on November 15. If the table is referred to and January 1 is positioned on the appropriate day of the week, the day of the week for November 15 may also be read.

To calculate time periods retrospectively, the time periods measured on the calculation disc 24 which run counter-clockwise are employed. In this case, line 32 in FIG. 3 illustrates that 40 days prior to December 25 is November 15. For calculations in a leap year over February 29, when calculations are required in days rather than in months, one or the other of lines 34 and 36 are to be employed. If measuring prospectively, the actual date is read from segment 38. If measuring retrospectively, the actual date is read from segment 40. If the time period does not extend over February 29, the regular cursor line 32 is employed. After measuring across February 29, the day of the week may be read directly from the day-of-the-week scale on the base 10 by using the third segment on leap-year cursor 34 or 36. Alternatively, the calendar disc can be set to correspond with the day of the week on either side of February 29, read directly for any other date on the same side, and shifted by one day for reading with any date on the other side of February 29.

Accordingly, a convenient method and apparatus for time period calculations is disclosed. While embodiments and applications of this invention have been shown and described, it would be apparent to those skilled in the art that many more modifications are possible without departing from the inventive concepts herein. The invention, therefore is not to be restricted except in the spirit of the appended claims.

What is claimed is:

1. A time period calculator, comprising a base;

a calendar disc rotatably mounted to said base about an axis and having 365 equiangular first divisions about said axis marked by calendar dates in sequence;

a calculation disc rotatably mounted to said base about said axis and having 365 equiangular second divisions about said axis immediately adjacent to said first divisions consecutively numbered from zero in each direction;

a cursor pivotally mounted to said base about said first axis, said cursor having a first straight line radially extending relative to said axis across said first and second divisions, second and third lines radially extending relative to said axis, said second and third lines including main segments extending over said second divisions and leap year segments extending over said first divisions, said leap year segments of said second and third lines being angularly displaced to the right and left, respectively, by the width of one said second division.

2. The time period calculator of claim 1 wherein said base has a first surface marked in equiangular third divisions about an axis, each third division being 1/365th of a full circle and including the days of the week consecutively represented in association with said third divisions, said first straight line further extends across said third divisions and said second and third lines including third segments extending over said third divisions in alignment with said main segments.

3. The time period calculator of claim 1 wherein said calculation disc further has the weeks of the year consecutively represented in association with said second divisions consecutively numbered from zero in each direction.

4. The time period calculator of claim 1 wherein said calculation disc further has months of the year represented by 12 equiangular divisions about said axis consecutively numbered from zero in each direction through a plurality of revolutions.

5. The time period calculator of claim 2 wherein said base further includes a table of the day of the week for each January lst for a plurality of years surrounding the year 1986.

* * * * *